US006106338A

United States Patent [19]

Wu et al.

[11] Patent Number: 6,106,338

[45] Date of Patent: Aug. 22, 2000

[54] CABLE END RECEPTACLE CONNECTOR HAVING A DEVICE PREVENTING EXCESS MOLTEN MATERIAL FROM FLOWING INTO THE CONNECTOR

[75] Inventors: Kun-Tsan Wu, Tu Chen; Song-Rong Chiou, Lin-Kou, both of Taiwan

[73] Assignee: Hon Hai Precision Ind. Co., Ltd., Taipei Hsien, Taiwan

[21] Appl. No.: 09/290,767

[22] Filed: Apr. 13, 1999

[30] Foreign Application Priority Data

Aug. 7, 1998 [TW] Taiwan ..... 87212931

[51] Int. Cl.[7] ..... H01R 24/00; H01R 33/00

[52] U.S. Cl. ..... 439/660; 439/903

[58] Field of Search ..... 439/607, 660, 439/874, 903, 395, 404

[56] References Cited

U.S. PATENT DOCUMENTS 5,667,393 9/1997 Grabbe ..... 439/660

*Primary Examiner*—Lincoln Donovan
*Assistant Examiner*—Javaid Nasri
*Attorney, Agent, or Firm*—Wei Te Chung

[57] ABSTRACT

A cable end receptacle connector includes a metal shell receiving a nonconductive body therein. The body has a cavity defined in a rear face thereof and a plurality of channels defined in a front face thereof in communication with the cavity. Each channel receives and retains a contact terminal therein. A cover member is fixed to the rear face of the body and substantially blocks the cavity. The cover member has a plurality of slots defined between spaced wall segments for receiving reduced sections of the corresponding contact terminals therein thereby securely retaining the contact terminals and effectively resisting an external load applied thereto. The cover member has a rear projection defining a plurality of spaced grooves therein for receiving and containing tail sections of the corresponding contact terminals. The tail sections are soldered to wires and the grooves confine excess molten soldering material that attaches the wires to the contact terminals. Thus, the soldering material is prevented from electrically connecting adjacent contact terminals.

16 Claims, 6 Drawing Sheets

CABLE END RECEPTACLE CONNECTOR HAVING A DEVICE PREVENTING EXCESS MOLTEN MATERIAL FROM FLOWING INTO THE CONNECTOR

BACKGROUND OF THE INVENTION

1. Field of the Invention

The present invention generally relates to an electrical connector, and in particular to a cable end receptacle connector which effectively prevents overflow of molten material into the connector.

2. The Prior Art

High frequency receptacle connectors, such as the disclosure of Taiwan design application No. 85310374, usually comprise a nonconductive body encased in a metal shell for eliminating electromagnetic interference. However, when a cable is mounted thereto, the connection interface between the cable and the connector is exposed and unshielded. Furthermore, an open space is formed around the connection interface. Not only is the electromagnetic shielding adversely affected, but molten solder for fixing the contact terminals or molten plastic for molding the body may overflow into the space around the connection interface thereby jeopardizing mechanical and electrical instability of the connector.

Furthermore, the connection interface between the connector and the cable is the location where an external load is applied to the cable when the receptacle connector is separated from a mating plug connector. Thus, the cable may become inadvertently disengaged from the connector, leading to malfunction of the connector.

It is thus desirable to have a cable end receptacle connector that overcomes the problems of the prior art.

SUMMARY OF THE INVENTION

Accordingly, an object of the present invention is to provide an electrical connector that is mechanically and electrically stable.

Another object of the present invention is to provide an electrical connector that can effectively resist an external axial load applied thereto.

A further object of the present invention is to provide an electrical connector that prevents material overflow of molten solder or plastic from entering the connector.

Yet another object of the present invention is to provide a cable end connector which has electrical shielding properties at the cable connection interface thereof.

To achieve the above objects, a cable end receptacle connector in accordance with the present invention comprises a metal shell receiving a nonconductive body therein. The body has a cavity defined in a rear face thereof and a plurality of channels defined in a front face thereof in communication with the cavity. Each channel receives and retains a contact terminal therein. A cover member is fixed to the rear face of the body and substantially blocks the cavity. The cover member has a plurality of slots defined between spaced wall segments for receiving reduced sections of the corresponding contact terminals therein thereby securely retaining the contact terminals and effectively resisting an external load applied thereto. The cover member has a rear projection defining a plurality of spaced grooves therein for receiving and containing tail sections of the corresponding contact terminals. The tail sections are soldered to wires and the grooves confine excess molten soldering material that attaches the wires to the contact terminals. Thus, the soldering material is prevented from electrically connecting adjacent contact terminals.

BRIEF DESCRIPTION OF THE DRAWINGS

The present invention will be apparent to those skilled in the art by reading the following description of the preferred embodiments thereof, with reference to the accompanying drawings, in which.

DETAILED DESCRIPTION OF THE PREFERRED EMBODIMENTS

Figure 1:
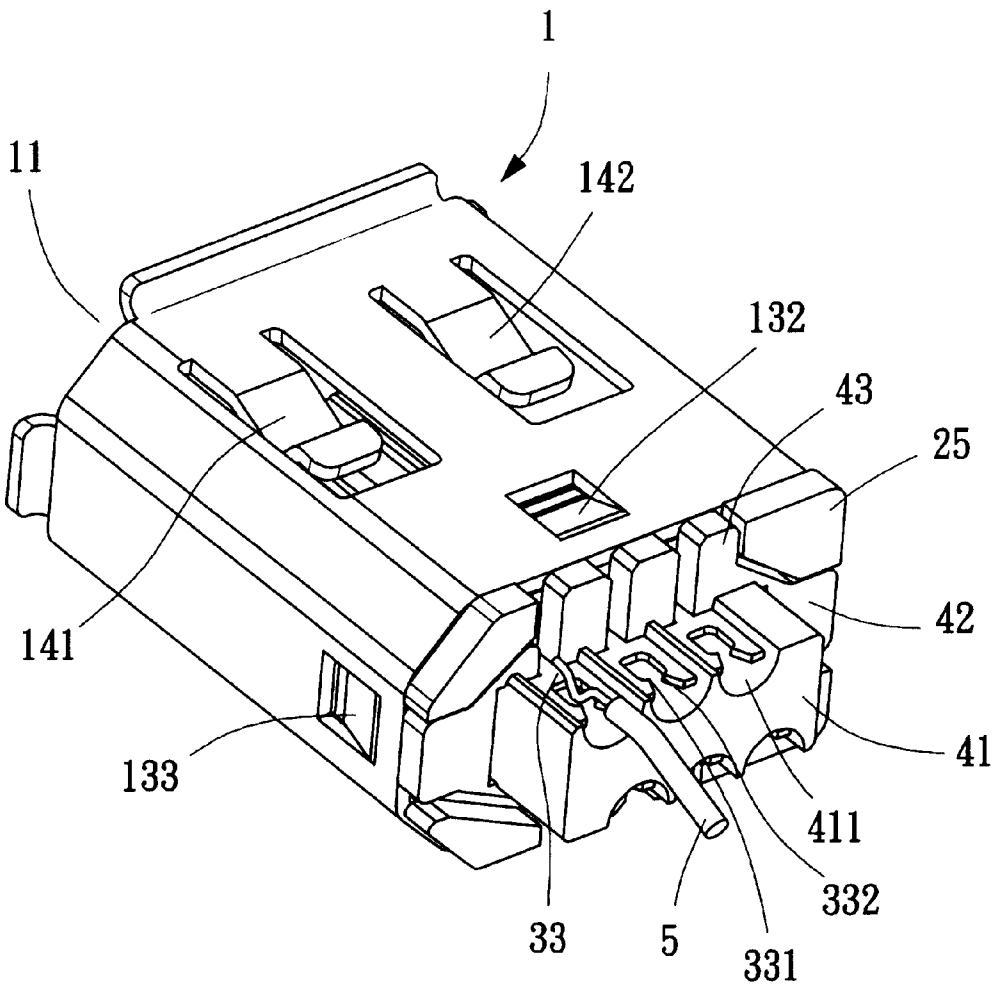
FIG. 1 is a perspective view of a cable end receptacle connector constructed in accordance with the present invention to which a cable comprising a number of wires is connected, only one wire being shown in the drawings.
Figure 2:
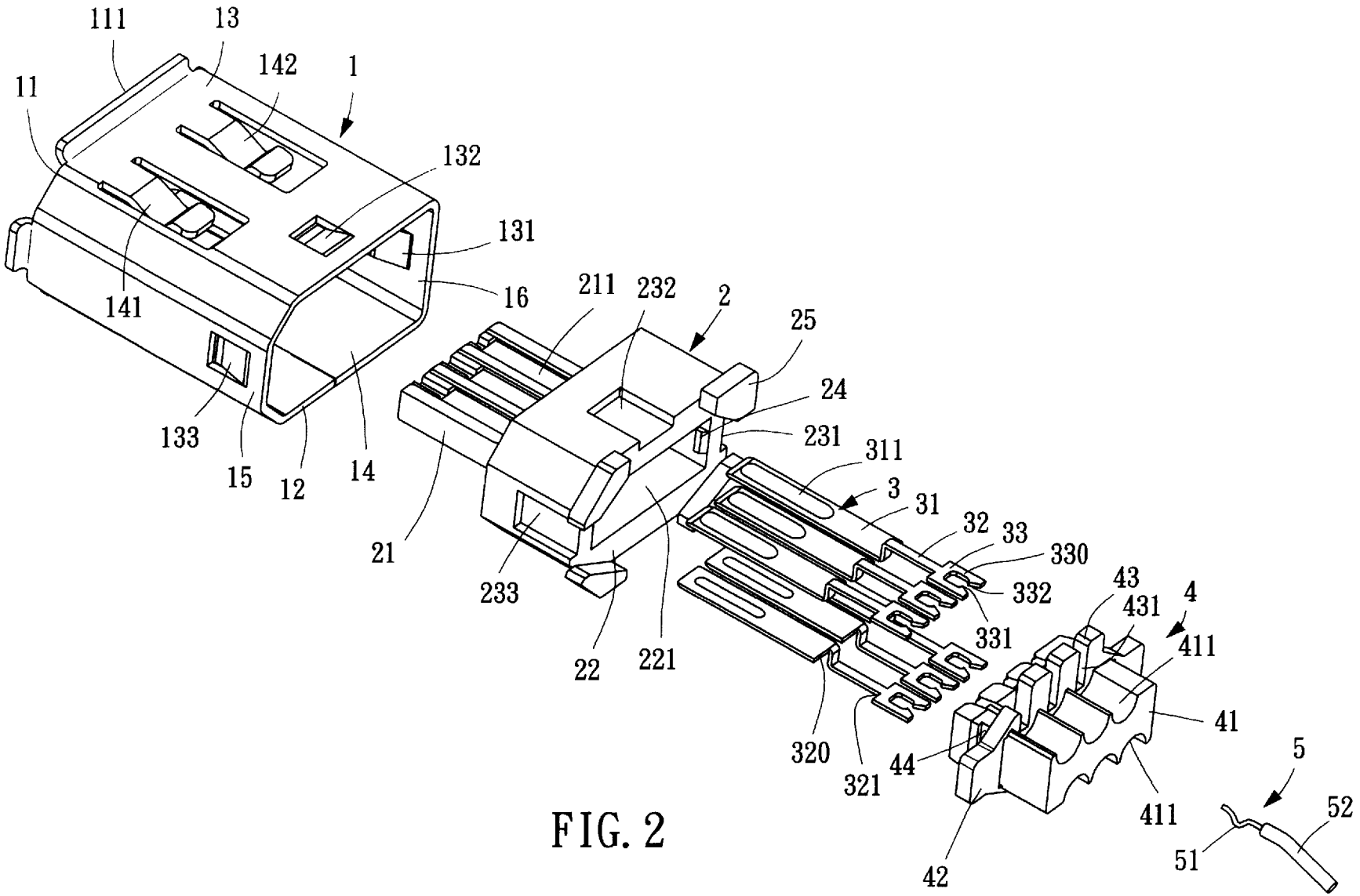
FIG. 2 is an exploded view of the cable end receptacle connector of FIG. 1.
Figure 3:
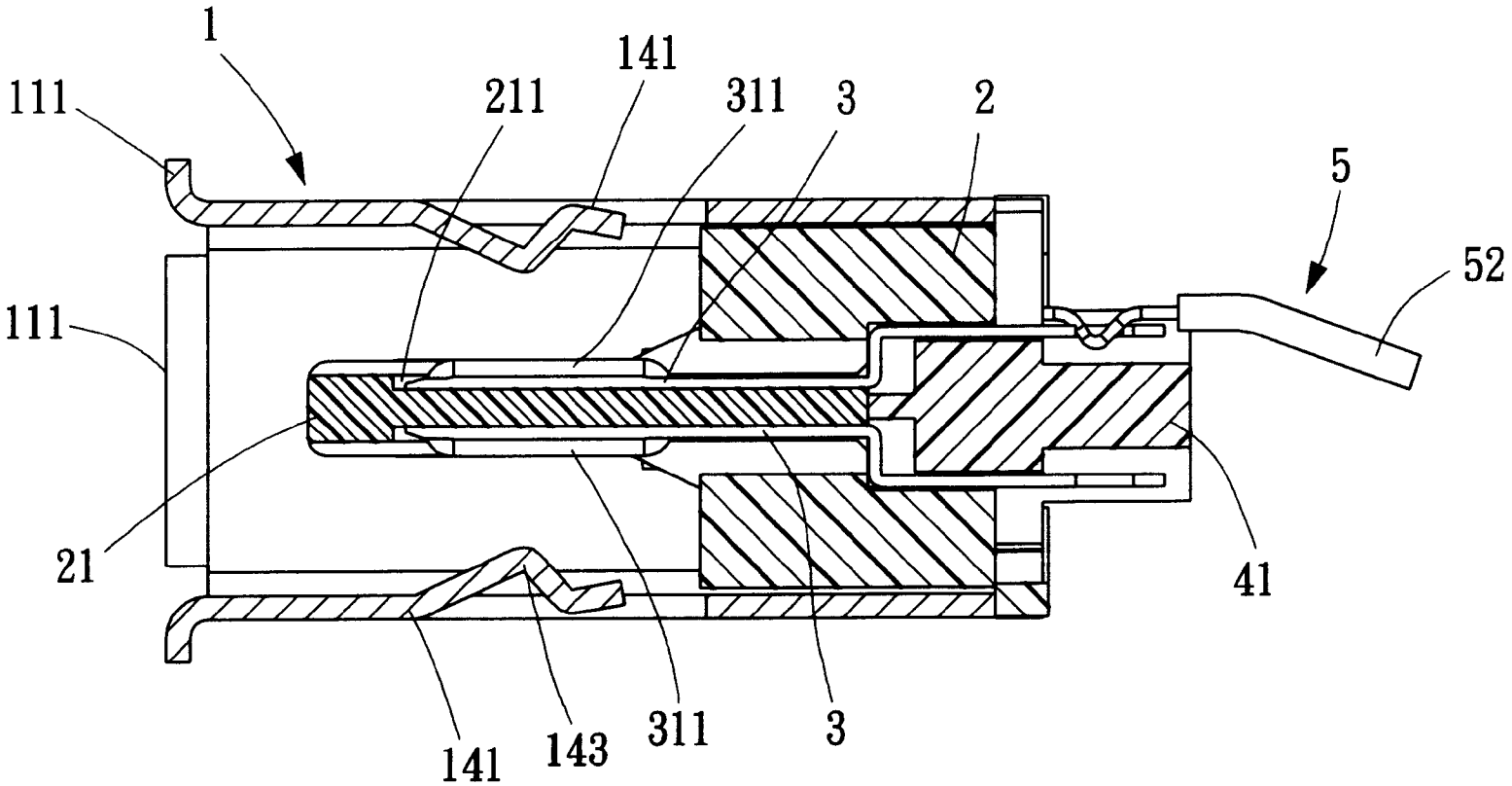
FIG. 3 is a cross-sectional view of the cable end receptacle connector of FIG. 1.
Figure 4:
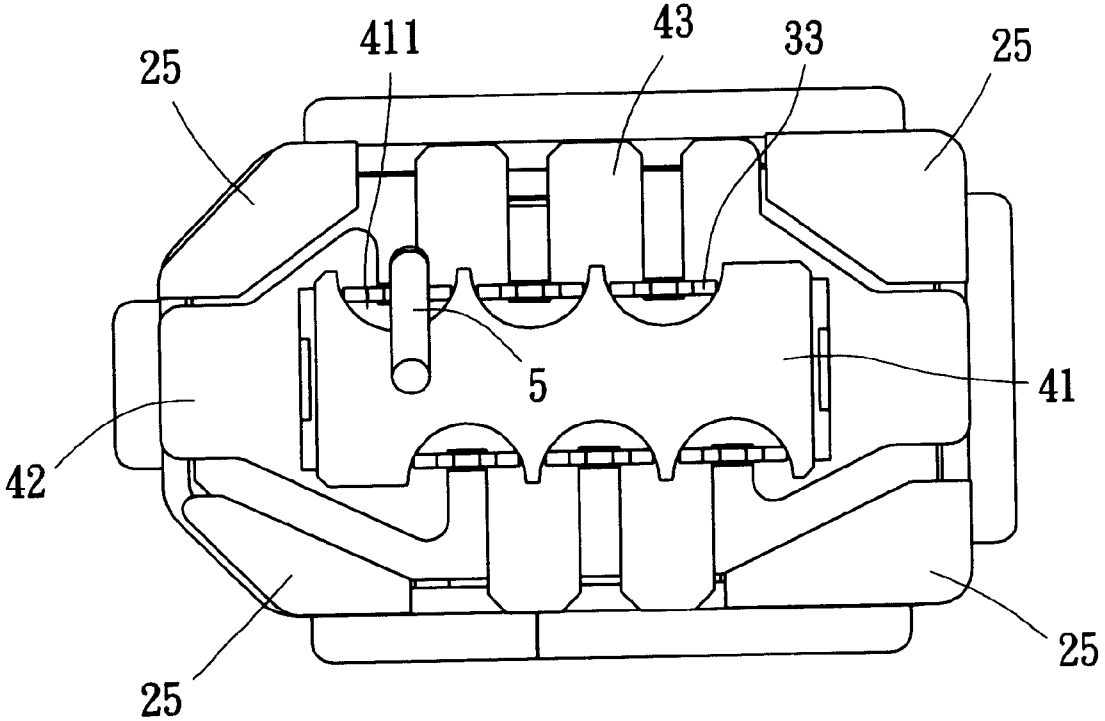
FIG. 4 is a rear end view of the cable end receptacle connector of FIG. 1.

Referring to the drawings and in particular to FIGS. 1 and 2, wherein a cable end receptacle connector constructed in accordance with the present invention is shown, the connector comprises a nonconductive body 2 received in a conductive casing 1. The casing 1 shields and protects the body 2 from electromagnetic interference. The casing 1 is preferably stamped and pressed from a metal sheet and has a top wall 13, a bottom wall 14, a left wall 15 and a right wall 16 connected together and defining a front opening 11 and a rear opening 12 therebetween. A pair of resilient arms 141, 142 are formed in each top and bottom wall 13, 14. Each arm 141, 142 forms an inwardly projecting barb 143 (FIG. 3) for engaging a mating plug connector (not shown). An outwardly protruding flange 111 extends from each wall 13, 14, 15, 16 from a periphery of the front opening 11.

The casing 1 also comprises a plurality of barbs 131, 132, 133. The body 2 has recesses 231, 232, 233 defined therein for engaging with the barbs 131, 132, 133 of the casing 1. The body 2 is inserted into the casing 1 through the rear opening 12 and the barbs 131, 132, 133 engage with the recesses 231, 232, 233 thereby retaining the body 2 in the casing 1.

The body 2 has a base 22 and a front projection 21 forwardly extending therefrom. The projection 21 has a plurality of terminal receiving channels 211 defined on opposite surfaces thereof. The base 22 defines a cavity 221 therein in communication with the channels 211. In the embodiment illustrated, the projection 21 has three channels 211 defined on each surface thereof.

Figure 5A:
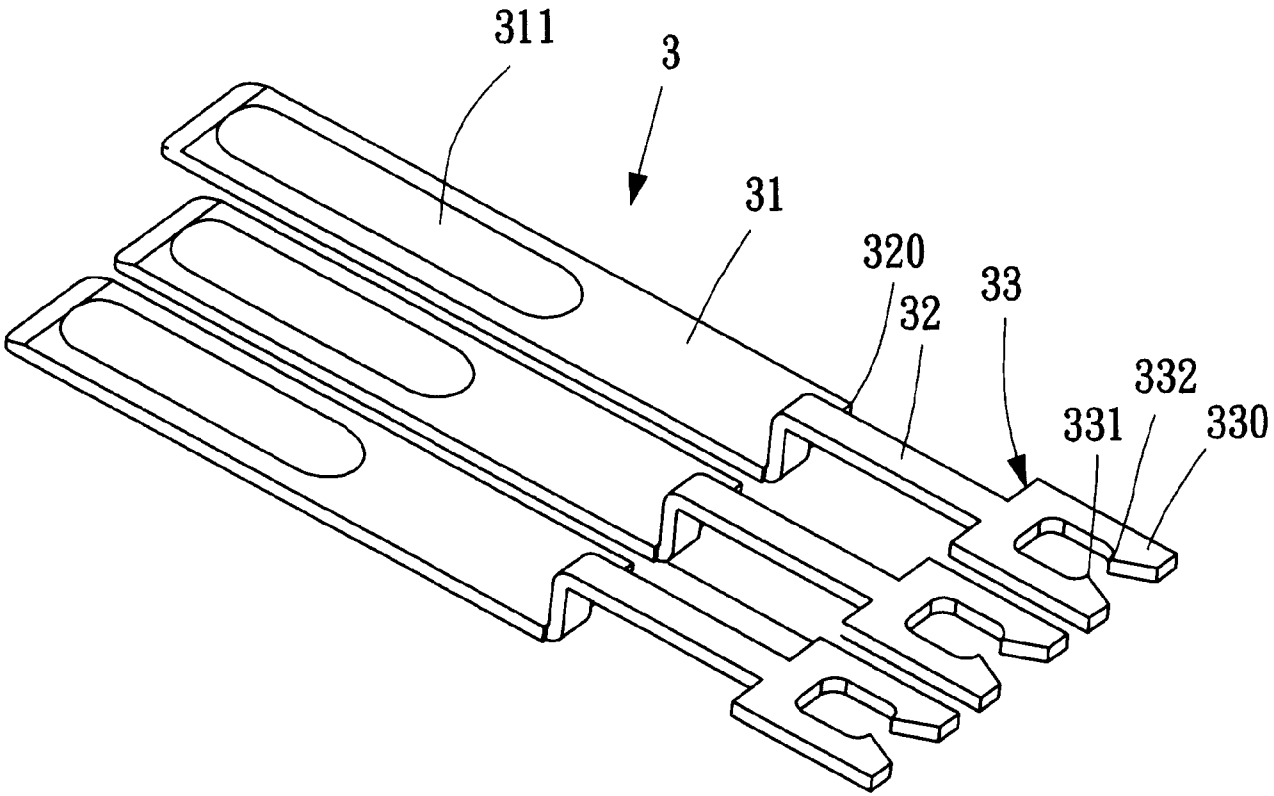
FIG. 5A is a perspective view of contact terminals used with the cable end receptacle connector of the present invention.

Each channel 211 receives a contact terminal 3 therein with a portion of the contact terminal 3 extending into the cavity 221 of the body 2. Each contact terminal 3 comprises a mating section 31 received in the corresponding channel 211 and a tail section 33 connected to the mating section 31 by means of a connection section 32 (best seen in FIGS. 5A and 5B). The tail section 33 extends beyond the rear opening 12 of the casing 1. The mating section 31 comprises a raised portion 311 for ensuring proper engagement with a corresponding contact terminal of the mating plug connector.

The tail section 33 is connected to a conductor core 51 of a wire 5 by means of soldering. In the embodiment illustrated in FIGS. 1, 2 and 5A, the tail section 33 has a bifurcated configuration comprising two arms 330. The arms 330 are spaced from each other and define an opening therebetween for receiving a leading end of the wire 5. Each arm 330 has a sharpened projection 331, 332 for establishing electrical connection between the arms 330 and the conductor core 51 of the wire 5.

Figure 5B:
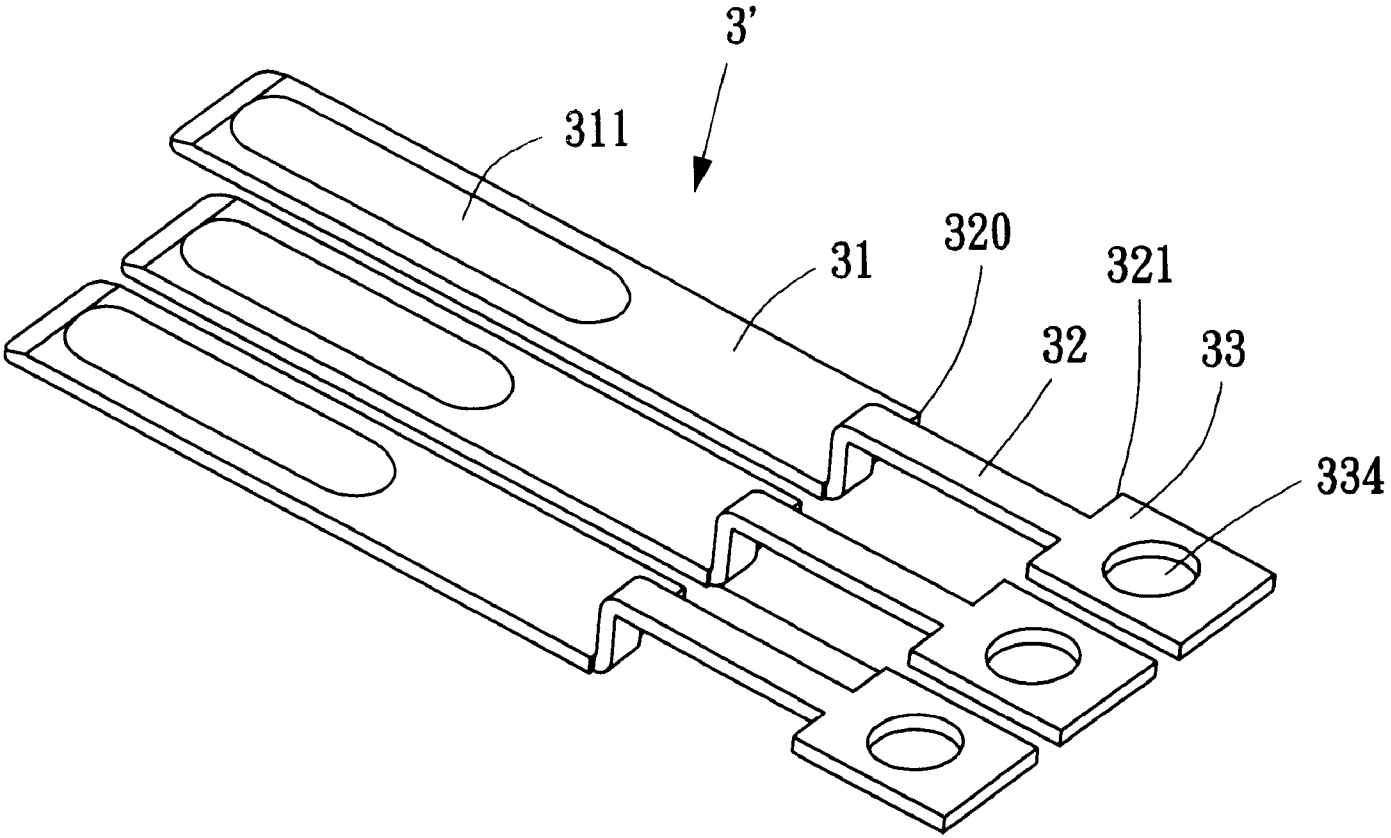
FIG. 5B is a perspective view of another embodiment of the contact terminals in accordance with the present invention.

In FIG. 5B, another embodiment of the contact terminal 3' is shown. The leading end of the wire extends through a hole 334 defined in the tail section 33. The hole 334 also allows excess molten soldering material to flow therethrough.

Referring back to FIGS. 1–4, a cover member 4 comprises a base plate 42 from which a projection 41 rearwardly extends. The base plate 42 is fit into the cavity 221 of the body 2 to substantially block the cavity 221 thereby preventing excess molten soldering material from flowing into the cavity 221 and forming undesired electrical connections. Preferably, the body 2 comprises flanges 25 which matingly engage with the base plate 42 for ensuring that the cavity 221 is completely blocked.

The cover member 4 has recesses 44 defined thereon. The recesses 44 are engaged by barbs 24 formed on the body 2 and extending into the cavity 221 for securing the cover member 4 thereto.

The projection 41 of the cover member 4 has opposite faces each defining a plurality of grooves 411 for receiving the tail sections 33 of the contact terminals 3. The base plate 42 defines a plurality of slots 431 between spaced wall segments 43 thereof. Each slot 431 corresponds to one of the grooves 411 for receiving the connection section 32 of the corresponding contact terminal 3. Preferably, the connection section 32 has a reduced neck portion received in the slot 431 thereby securely retaining the contact terminals 3 in position. Thus, the connection section 32 forms a shoulder 320, 321 with both the mating section 31 and the tail section 33.

The groove 411 which receives the tail section 33 contains excess molten soldering material during the process of soldering the conductive core 51 of the wire 5 to the tail portion 33 of the corresponding contact terminal 3 thereby preventing the excess soldering material from electrically engaging adjacent wires 5

Disposing the neck portion of the connection section 32 in the slot 431 forms an engagement between the shoulders 320, 321 of the connection section 32 and the wall segments 43 thereby allowing the contact terminals 3 to withstand an external axial load applied thereto.

Although the present invention has been described with reference to preferred embodiments thereof, it is apparent to those skilled in the art that a variety of modifications and changes may be made without departing from the scope of the present invention which is intended to be defined by the appended claims.

What is claimed is:

1. An electrical connector adapted to be secured to an electrical cable comprising a number of wires, each wire having a conductor core surrounded by an insulation sheath, the connector comprising:

a conductive casing having a front opening for receiving a mating connector and a rear opening;

a nonconductive body comprising a base defining a cavity therein and a front projection forwardly extending from the base, the front projection having a plurality of terminal receiving channels defined on surfaces thereof and in communication with the cavity, the body being received and retained in the casing through the rear opening of the casing with the front projection extending toward the front opening;

a cover member mounted to the body to substantially block the cavity, the cover member comprising a rear projection rearwardly extending therefrom, the rear projection defining a plurality of grooves therein, the cover member further comprising wall segments defining slots therebetween, the slots communicating between the cavity and the corresponding grooves; and a contact terminal having a mating section received and retained in each of the channels of the body, a tail section disposed in each of the grooves of the cover member, and a reduced section connecting the tail section to the mating section, the reduced section being received in the corresponding slot, the tail section being soldered to the conductor core of each of the wires by means of soldering material, the soldering material being confined in the groove.

2. The electrical connector as claimed in claim 1, wherein the cover member defines recesses therein for engaging with barbs formed on the body and extending into the cavity to secure the cover member to the body.

3. The electrical connector as claimed in claim 1, wherein the body has recesses defined on the base thereof and wherein the casing comprises barbs for engaging with the recesses of the body thereby securing the body in the casing.

4. The electrical connector as claimed in claim 1, wherein the tail section of the contact terminal comprises a bifurcated configuration having two spaced arms, each arm comprising a sharpened projection for establishing electrical connection between the arms and the conductor core of a corresponding wire.

5. The electrical connector as claimed in claim 1, wherein the tail section of the contact terminal defines a hole therein for receiving a leading end of the conductor core of the wire therein.

6. An electrical connector adapted to connect to a cable having a number of wires, comprising:

a nonconductive body having a cavity defined in a rear face thereof and a plurality of channels defined in a front face thereof, the channels being in communication with the cavity;

contact terminals received in the cavity with mating sections of the contact terminals extending through the channels and tail sections extending beyond the rear face of the body; and a cover member fixed to the rear face of the body for substantially blocking the cavity, the cover member having spaced wall segments defining slots therebetween, the tail section of each contact terminal extending beyond the rear face of the body.

7. The electrical connector as claimed in claim 6, wherein the cover member defines a plurality of separate receiving spaces in communication with the corresponding slots for receiving the tail sections of the contact terminals therein and for confining soldering material used to solder wires to the contact terminals.

8. The electrical connector as claimed in claim 7, wherein the tail section of the contact terminal defines a hole through which excess soldering material produced during soldering the wires to the contact terminals flows.

9. The electrical connector as claimed in claim 6 further comprising a metal casing enclosing the body for shielding the body from electromagnetic interference.

10. The electrical connector as claimed in claim 9, wherein the casing comprises barbs for engaging with recesses defined in the body for retaining the body in the casing.

11. The electrical connector as claimed in claim 6, wherein the body forms barbs extending into the cavity and wherein the cover member comprises recesses defined therein, the recesses engaging with the barbs for securing the cover member to the body.

12. The electrical connector as claimed in claim 6, wherein the body forms mating flanges on the rear face thereof defining a space therebetween for accommodating the cover member therein and for ensuring that the cavity is completely blocked by the cover member.

13. The electrical connector as claimed in claim 6, wherein the contact terminal comprises a reduced section connecting the tail section to the mating section, the reduced section forming a shoulder with each tail section and each mating section, the reduced section being received in the slot with the shoulders engaging the corresponding wall segments.

14. The electrical connector as claimed in claim 6, wherein the tail section of the contact terminal has a bifurcated configuration, comprising two spaced arms, each arm having a sharpened projection for establishing electrical connection between the arms and the conductor core of a corresponding wire.

15. The electrical connector as claimed in claim 6, wherein the tail section of the contact terminal defines a hole through which a leading end of the wire extends.

16. An electrical assembly comprising:

a connector including a nonconductive body defining opposite front and rear faces thereof, a mating projection formed on a front face;

a plurality of contact terminals disposed in the body, each of said contact terminals including a mating section positioned on the mating projection, and a tail section extending beyond the rear face;

a cover member positioned around the rear face, said cover member cooperating with the rear face of the housing to sandwich the contact terminals therebetween thereby forming no communicative space between the tail section and the mating section of each of said contact terminals, said cover member defining therein a plurality of grooves in respective alignment of the tail sections of the corresponding contact terminals; and a cable including at least one wire generally positioned in one corresponding groove with an internal conductor core connected to the tail section of the corresponding contact terminal thereof.

* * * * *